US008550299B2

(12) United States Patent
Lohmann

(10) Patent No.: US 8,550,299 B2
(45) Date of Patent: Oct. 8, 2013

(54) METHODS AND DEVICES FOR ENCOURAGING, EDUCATING, ENTERTAINING AND MOTIVATING CHILDREN TO BRUSH THEIR TEETH

(76) Inventor: Alicia H. Lohmann, Burnsville, MN (US)

( * ) Notice: Subject to any disclaimer, the term of this patent is extended or adjusted under 35 U.S.C. 154(b) by 141 days.

(21) Appl. No.: 13/180,965

(22) Filed: Jul. 12, 2011

(65) Prior Publication Data

US 2013/0015201 A1 Jan. 17, 2013

(51) Int. Cl.
*B05B 11/00* (2006.01)

(52) U.S. Cl.
USPC ..... 222/78; 222/39; 222/186; 222/192; 222/638; 222/639; 222/481.5; 248/110; 248/908; 446/397; 446/475

(58) Field of Classification Search
USPC ..... 222/78, 39, 105, 192, 638–639, 186, 222/481.5; 424/10.1, 10.3, 10.32; 446/72–74, 446/80–81, 397, 475; 248/110, 908
See application file for complete search history.

(56) References Cited

U.S. PATENT DOCUMENTS

| | | | | | |
|---|---|---|---|---|---|
| 2,771,219 | A | * | 11/1956 | Dewey | 222/93 |
| 3,170,265 | A | * | 2/1965 | Goldfarb | 446/73 |
| 3,178,060 | A | * | 4/1965 | Bossack | 222/78 |
| 4,010,870 | A | * | 3/1977 | Wilson | 222/78 |
| 4,878,845 | A | | 11/1989 | Lindsay et al. | |
| D311,425 | S | | 10/1990 | Lindsay | |
| 5,048,143 | A | | 9/1991 | Carroll | |
| 5,078,732 | A | | 1/1992 | Ceniceros | |
| 5,228,595 | A | * | 7/1993 | Booker | 222/78 |
| 5,230,648 | A | * | 7/1993 | Kelley et al. | 446/74 |
| 5,232,370 | A | | 8/1993 | Hoye | |
| 5,288,233 | A | | 2/1994 | Green | |
| 5,348,030 | A | | 9/1994 | Hirzel | |
| 5,400,839 | A | * | 3/1995 | Cravett | 141/362 |
| 5,507,414 | A | * | 4/1996 | Ong | 222/108 |

(Continued)

FOREIGN PATENT DOCUMENTS

| | | |
|---|---|---|
| WO | WO 97/00630 | 1/1997 |
| WO | WO 2006/078360 | 7/2006 |

*Primary Examiner* — Frederick C Nicolas
(74) *Attorney, Agent, or Firm* — Antonio Papageorgiou; Ostrow Kaufman LLP

(57) ABSTRACT

The present invention is methods and devices for encouraging, educating, entertaining, and or motivating children to brush their teeth. In preferred embodiments of the invention, one or more characters are used, each with its own look and personality. The characters are used in a variety of forms and media as the shape of functional devices, advertising, education and entertainment. The characters may also be animated. The characters and their images, associated slogans and brand name may be used on a line of merchandise. The invention in a preferred embodiment includes a toothpaste dispenser or a toy in the shape of one of the characters. The toothpaste dispenser or toy, in a preferred embodiment, is able to talk to, play a song or otherwise communicate with the child to give entertaining, educational or motivating messages to the child regarding brushing their teeth. The invention in another embodiment includes one or more of the characters in the form of finger and or hand puppets. In a preferred embodiment of the hand puppet, the hand puppet has a body in the shape of a smile and toothbrush legs. In another embodiment of the invention, the character is presented in several media including, but not limited to, television, movies, websites, video games, board games, books, magazines, coloring books, stuffed animals, toys, puppets or figurines.

19 Claims, 10 Drawing Sheets

(56) References Cited

U.S. PATENT DOCUMENTS

| | | | | |
|---|---|---|---|---|
| 5,570,325 | A * | 10/1996 | Arpadi | 368/10 |
| 5,774,921 | A * | 7/1998 | Harrison et al. | 15/145 |
| 5,974,619 | A | 11/1999 | Weihrauch | |
| 5,980,869 | A * | 11/1999 | Sanker et al. | 424/58 |
| 6,074,076 | A | 6/2000 | Parrish-Bhagwat | |
| 6,363,568 | B1 * | 4/2002 | Harrison et al. | 15/167.1 |
| 6,547,104 | B1 * | 4/2003 | Wilkinson | 222/192 |
| 6,614,727 | B2 | 9/2003 | McGuire | |
| 7,475,794 | B2 * | 1/2009 | Walther et al. | 222/78 |
| 2004/0200748 | A1 | 10/2004 | Klassen et al. | |
| 2006/0160060 | A1 | 7/2006 | Algayed | |
| 2008/0054019 | A1 * | 3/2008 | Stechschulte et al. | 222/78 |
| 2008/0131844 | A1 | 6/2008 | Taylor | |
| 2008/0227071 | A1 | 9/2008 | Gavriel et al. | |
| 2009/0219787 | A1 | 9/2009 | Ortega | |
| 2010/0175208 | A1 | 7/2010 | Hilfinger et al. | |

* cited by examiner

METHODS AND DEVICES FOR ENCOURAGING, EDUCATING, ENTERTAINING AND MOTIVATING CHILDREN TO BRUSH THEIR TEETH

BACKGROUND OF THE INVENTION

This invention relates to methods and devices for encouraging and motivating children to brush their teeth.

Toothpaste companies have recognized a need for interesting ways to invite, encourage and motivate children to brush their teeth. One such approach has been to license characters already familiar to children from television or movies and put these images on tubes of toothpaste. The marketing idea is that a child will be attracted to and therefore purchase a particular tube of toothpaste by virtue of recognizing a favorite character. However, the licensed character did little and in some cases nothing to encourage, educate, entertain or motivate the child to brush his or her teeth.

From the foregoing it can be seen what is needed are methods and devices for encouraging and motivating a child to brush his or her teeth.

SUMMARY OF THE INVENTION

In at least one embodiment, a toothpaste dispenser having an appearance of a character is provided, the toothpaste dispenser comprising: a base; a support extending from a first end essentially vertically from the base; and a toothpaste tube holder located at a second end of the support opposite the first end, the toothpaste tube holder capable of being removably coupled to a toothpaste tube.

In at least one embodiment, the base comprises at least indentation therein to receive a first end of a toothbrush and the toothpaste holder comprises at least one hook correspondingly located thereon to receive a second end of the toothbrush.

In at least one embodiment, the toothpaste tube comprises at least one of facial and body features.

In at least one embodiment, the toothpaste tube holder is cylindrically concave and sized to receive a toothpaste tube with a flip-top cap and frictionally retain the toothpaste tube therein.

In at least one embodiment, the toothpaste tube holder has a plurality of air holes located annularly therein.

In at least one embodiment, the toothpaste tube holder is cylindrically concave and wherein an internal surface of the cylindrical tube holder has threads sized to mate with threads on a dispensing end of the toothpaste tube.

In at least one embodiment, the toothpaste tube comprises a dispenser having a conduit there through to dispense toothpaste from the toothpaste tube.

In at least one embodiment, the base comprises a plurality of indentations therein each to receive a first end of a toothbrush and the toothpaste holder comprises a plurality of hooks each correspondingly located thereon to receive a second end of the toothbrush, the toothpaste tube comprises at least one of facial and body features, the dispenser comprising a plurality of toothbrushes, each having a shape of the character's leg, the indentations and hooks located on the dispenser for the toothbrushes to appear as legs extending from the toothpaste tube.

In at least one embodiment, each of the toothbrushes comprises a bendable knew with a plurality of detents that lock in a shape in one of a plurality of configurations.

In at least one embodiment, each of the toothbrushes comprise a friction surface.

In at least one embodiment, at least one of the toothbrushes comprises a floss holder located at an end of the toothbrush opposite the bristles thereof.

In at least one embodiment, the floss holder includes a first ridge and a second ridge located at an end of the toothbrush and has a slot formed between the first ridge and the second ridge, the floss holder further includes a groove located at approximately a right angle to the first ridge, second ridge and a slot between the ridges, the groove has a width and a depth slightly wider and deeper than a diameter of floss used in the floss holder, the floss usable by pulling the floss taught across the slot.

In at least one embodiment, the base comprises a communication system operable to track and communicate to a user at least one of time spent brushing and a number of times teeth were brushed.

In at least one embodiment, the toothpaste dispenser comprises animated at least one of facial and body features.

In at least one embodiment, the animated feature comprises one of a mouth and eyelids.

In at least one embodiment, the dispenser comprises at least one sensor that detects usage and causes the animated features to move in response to usage.

In at least one embodiment, the dispenser dispenses toothpaste that changes from a first color to another color as the user brushes with the toothpaste.

In at least one embodiment, the toothpaste comprises a compound that changes color when exposed to air.

Additional aspects of the present invention will be apparent in view of the description which follows.

BRIEF DESCRIPTION OF THE FIGURES

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

Figure 1:
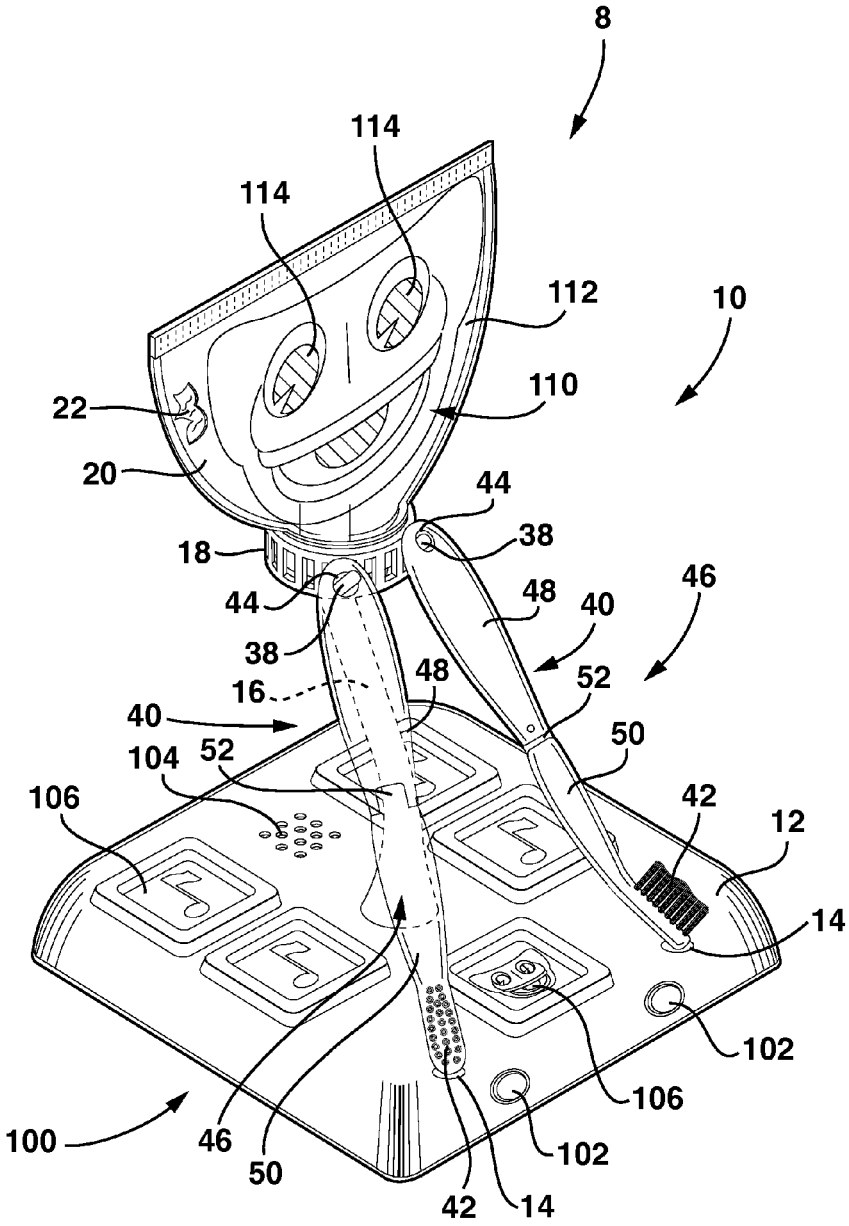
FIG. 1 is a perspective view of a dispenser embodiment of the invention.
Figure 2:
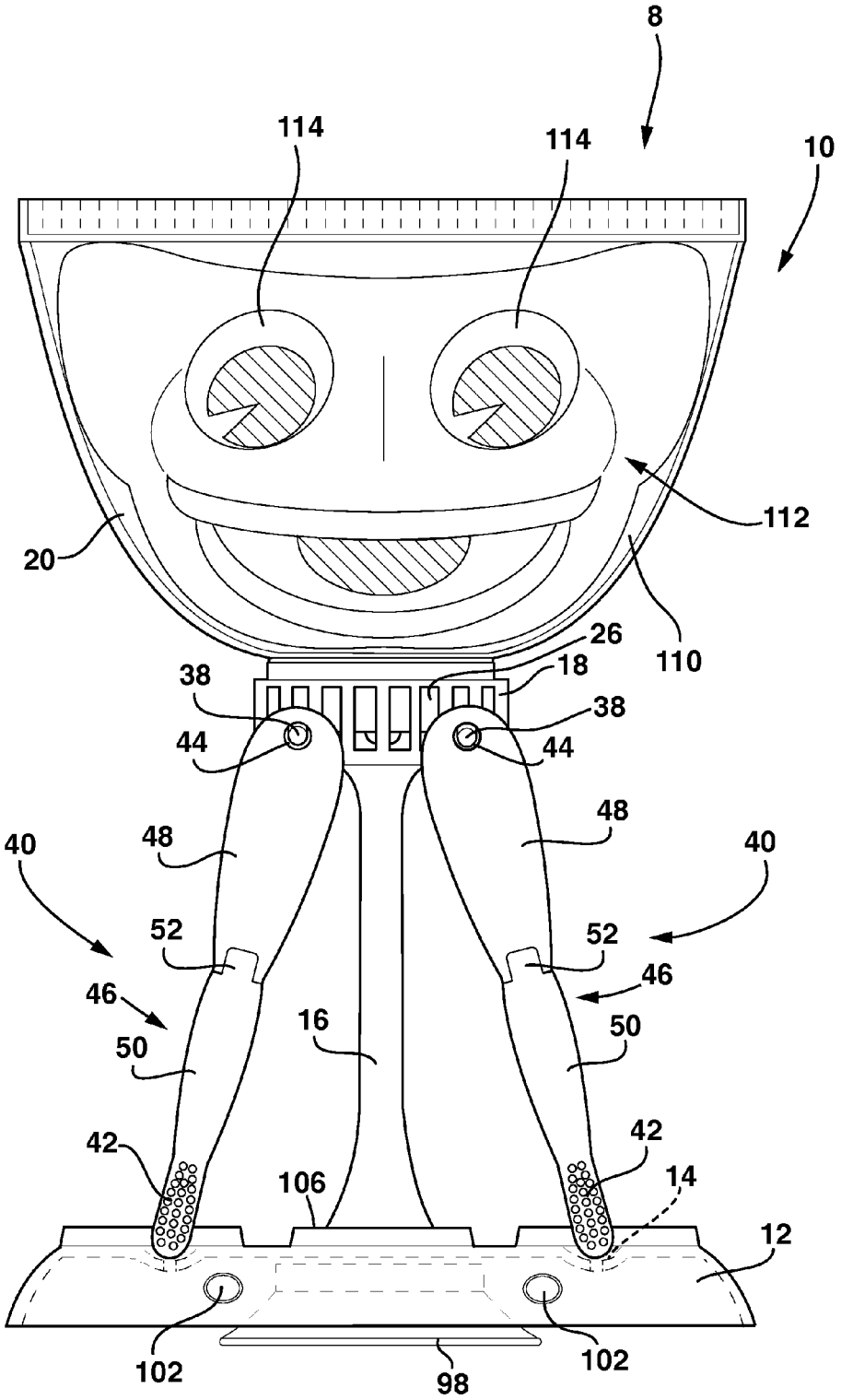
FIG. 2 is a front view of the dispenser embodiment of FIG. 1.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

Where used in the various figures of the drawings, the same numerals designate the same or similar parts. Furthermore, when the terms "top", and "side", and similar terms are used herein, it should be understood that these terms have reference only to the structure shown in the drawings as it would appear to a person viewing the drawings and are utilized only to facilitate describing the preferred embodiments.

DETAILED DESCRIPTION OF THE INVENTION

In order that the invention may be clearly understood and readily carried into effect, preferred embodiments of the invention will now be described, by way of example only, with reference to the accompanying drawings. The invention includes methods and devices for entertaining, educating and motivating children to brush their teeth. When the word toothpaste is used. It also means tooth-gels, toothpowders and other chemical compositions for cleaning the teeth and gums. Overarching all the methods and devices, the invention includes one or more characters 8 that appear in a variety of embodiments. Each character 8 is preferably intended to captivate children, invite them to brush, educate them about brushing and generally entertain and generate fun. The present invention is described in the following Examples, which are set forth to aid in the understanding of the invention, and should not be construed to limit in any way the scope of the invention as defined in the claims which follow thereafter.

In a preferred embodiment, the character 8 is broadly based on a smile. In this embodiment, each character 8 preferably has a face generally in the shape of a smile or a face having a distinctive smile, bright eyes and toothbrush-like legs with simulated "toothpaste" on the brush. As part of the invention, it is intended to create a variety of "looks" for the characters 8 through the addition of features such as lips, mouth shapes, eyelashes, eyebrows, mustaches, freckles, cheeks, eyewear, masks and other "disguises." Of course, these features could be varied in both size, thickness, color, contour, texture and shape to produce various characters or emotions or expressions of a single character. Preferably, each character 8 has a name identifying the color, flavor or other attribute of a corresponding toothpaste. Examples of such names include, but are certainly not limited to: Beep Beep Berry, Hachoo Cherry, Whoa Watermelon, Shhtrawberry, Yippee Yemon, Berry Burp, Puckerlips Lemon, Kiss Kiss Kiwi, Uh-Oh Orange, Blowing Raspberries, Cherry Cheery, Blue-B-Boo, Strawberry Smooch, Lemon Sweetie, Lippy Lime, Lime Slime and Banana Blabba. Further, in addition or in the alternative, each character 8 has a unique sound, behavior, feeling or identifying feature of its face.

In one preferred embodiment of the invention, a character 8 appears as a toothpaste dispenser shown in the drawings generally labeled 10. The dispenser 10 includes a base 12 having at least one indentation 14, a support 16 and a toothpaste tube holder 18. The support 16 extends up from the base 12, more or less vertically, and supports the toothpaste tube holder 18. The toothpaste tube holder 18 holds a toothpaste tube 20 holding toothpaste 22 preferably where the toothpaste tube 20 is in the shape of the face or face and body of a character 8. When assembled, the dispenser 10 preferably has the appearance of one of the characters 8.

Figure 3:
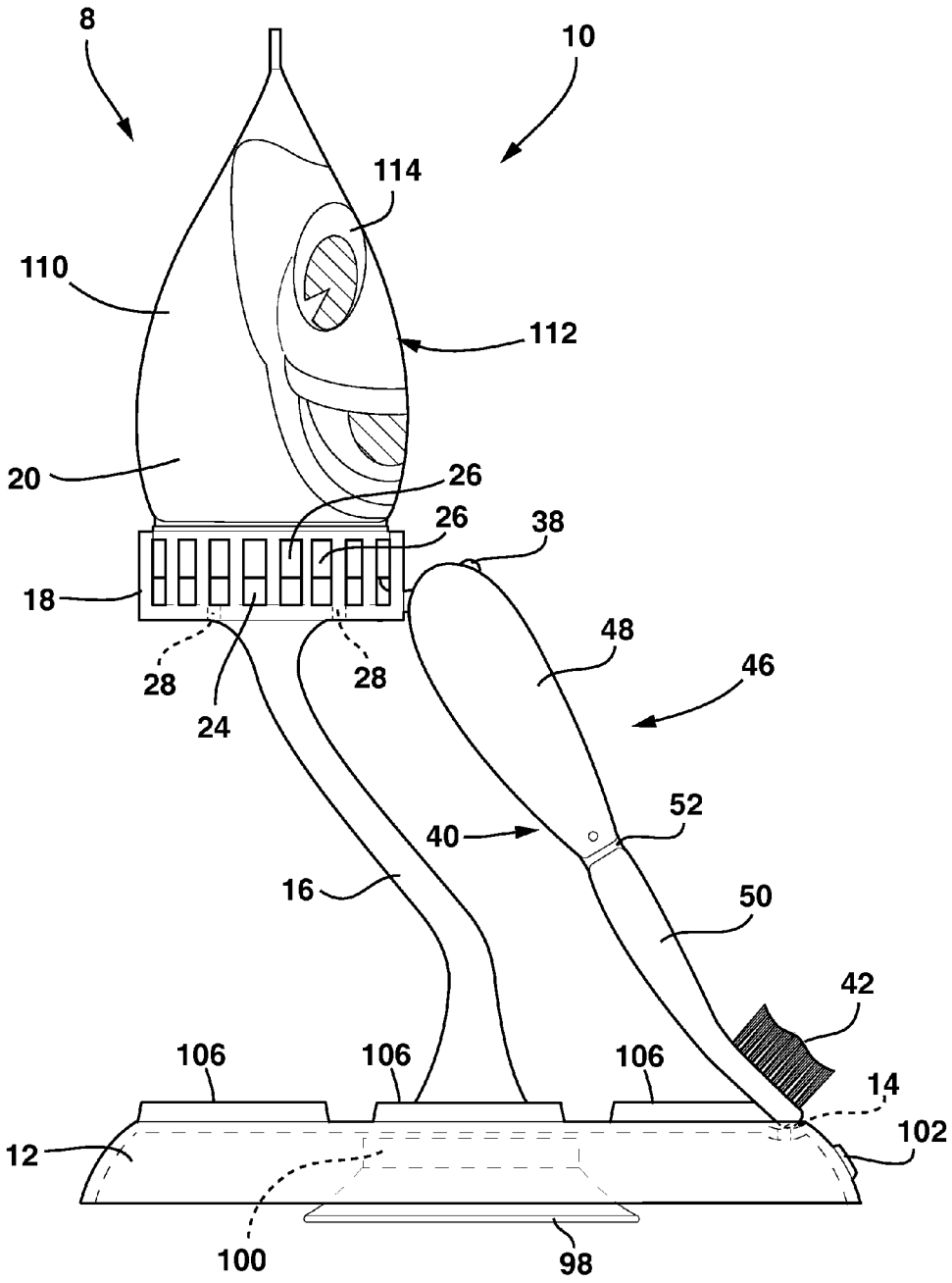
FIG. 3 is a side view of the dispenser embodiment of FIG. 1.

The toothpaste tube holder 18 in the preferred embodiment shown in FIG. 3 is cylindrically concave and sized to receive, in mating fashion, the flip-top cap 24 commonly found on toothpaste tubes 20. In this way, the flip-top cap 24 of the toothpaste tube 20 is inserted into the toothpaste tube holder 18. In a preferred embodiment of the toothpaste tube holder 18, the flip-top cap 24 of the toothpaste tube 20 is frictionally retained in the toothpaste tube holder 18. Although retaining the flip-top cap 24 within the toothpaste tube holder 18 by friction is the preferred way of retaining the toothpaste tube holder 18, other means of retaining the toothpaste tube holder 18 may be used as will be clear to those skilled in the art including, but not limited to, mechanical constraint.

The toothpaste tube holder 18 in this embodiment also preferably includes at least one air hole 26 located around the toothpaste tube holder 18 to allow fresh air to circulate around the toothpaste tube holder 18. In addition or in the alternative, the toothpaste tube holder 18 may also include at least one drain hole 28 located at or near the bottom of the toothpaste tube holder 18 to allow any moisture that may be present in the toothpaste tube holder 18 or on the flip-top cap 24 to drain from the toothpaste tube holder 18 to help keep the toothpaste tube holder 18 clean and sanitary.

Figure 4:
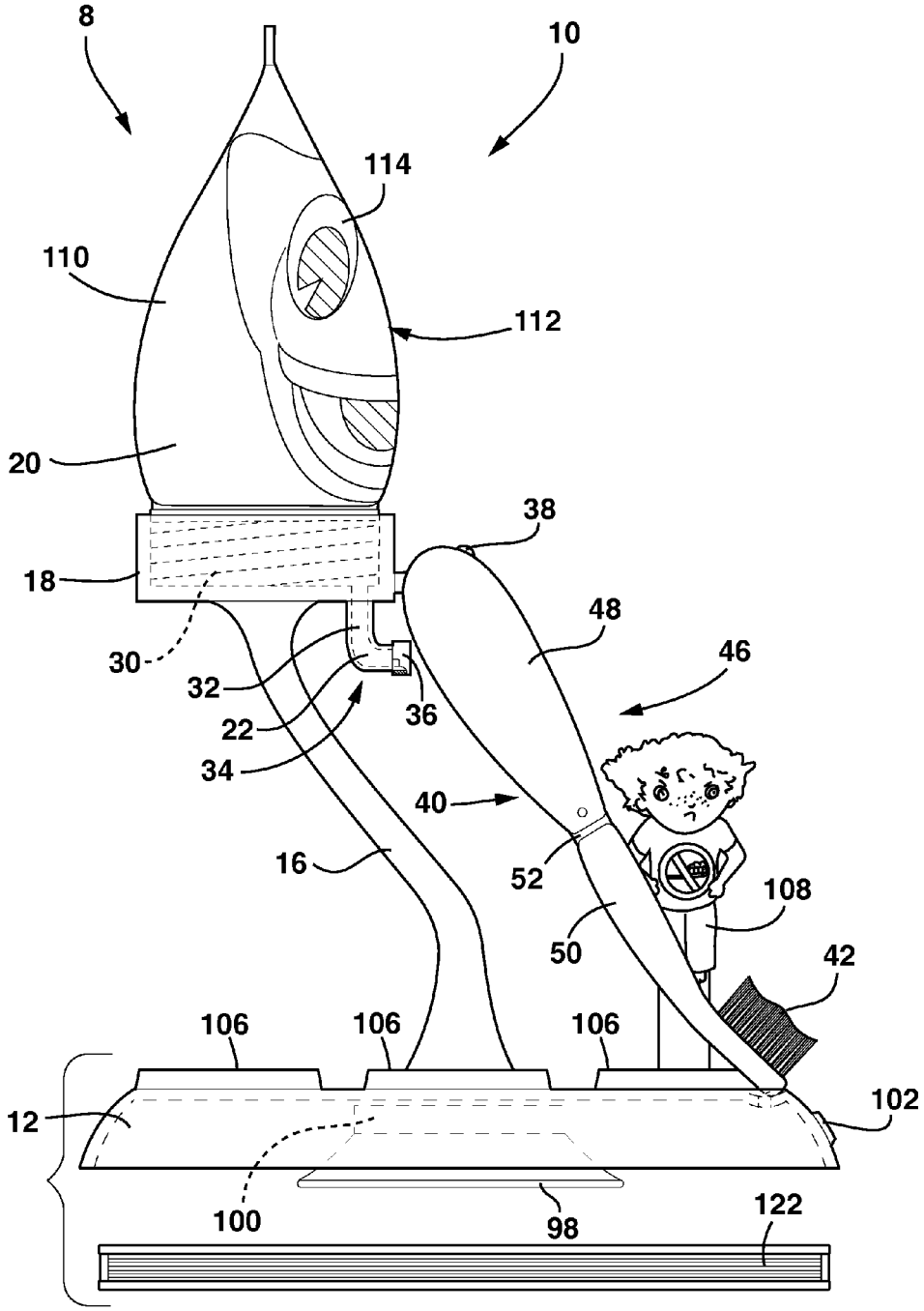
FIG. 4 is a side view of an alternate embodiment of the dispenser of FIG. 1.

In an alternate embodiment of a toothpaste tube holder 18 shown in FIG. 4, the toothpaste tube holder 18 is again cylindrically concave. However, in this embodiment, the toothpaste tube holder 18 has threads 30 on its internal surface sized to mate with the threads commonly found on toothpaste tubes 20 having screw tops. The toothpaste tube holder 18 may either than itself act as a cap for the toothpaste tube 20 or, as shown in FIG. 4, have a conduit 32 connected to the toothpaste tube 20 and having a dispensing end 34 so that toothpaste 22 in the toothpaste tube 20 may flow from the toothpaste tube 20 through the conduit 32 and be dispensed out of the dispensing end 34. The toothpaste tube holder 18 in this embodiment also preferably has means for closing the conduit 32 such as placing a cap 36 on the dispensing end 34. The cap 36 may be of the type that screws on to the dispensing end 34 or may be a flip-top cap attached to the dispensing end 34 through a living hinge.

As stated, in a preferred embodiment of the invention, the toothpaste tube 20 is in the shape of the face or face and body of a character 8. In a more preferred embodiment of the toothpaste tube 20, the character 8's face is in the shape of a smile as shown in FIGS. 1-4. The toothpaste tube 20 is set into the toothpaste tube holder 18 allowing easy access to the toothpaste tube 20 in the embodiment of FIG. 3 and an easy and constant flow of toothpaste out of the toothpaste tube 20 in the embodiment of FIG. 4. In use, the removable toothpaste tube 20 sits in the toothpaste tube holder 18 atop the support 16 giving the dispenser 10 the appearance of one of the characters 8. It is clear that different characters 8 are presented by placing the toothpaste tube 20 associated with a particular desired character 8 in the toothpaste tube holder 18. This way, a child can have his or her favorite character 8 displayed or various characters 8 can be displayed over time as a new toothpaste tube 20 with a new character 8 is placed in the toothpaste tube holder 18.

In preferred embodiments of the dispenser shown in FIGS. 1-4, the dispenser 10 also has hooks 38 that hold toothbrushes 40 with bristles 42 on one end and a hole 44 on the opposite end. In this embodiment, the hooks 38 are attached to the toothpaste tube holder 18 so that the toothbrushes 40 hang down from the hooks 38 by the interaction between a hook 24 and a hole 44 on the toothbrush 40. Although the hooks 38 have been described as being attached to the toothpaste tube holder 18, they may also be attached to other parts of the dispenser 10 such as the support 16 or the base 12. Other methods of holding the toothbrushes 40 besides hooks 38, as will be well understood by those skilled in the art, may be used as well including but not limited to slots, slits or other openings or ledges in the base 12, support 16 or toothpaste tube holder 18 dimensioned to hold a toothbrush 40 in a mechanical or frictional fit or being made of or lined with deformable material that mechanically or frictionally holds a toothbrush 40 and magnets (e.g., a magnet in a toothbrush 40 and another magnet in the dispenser 10). The dispenser can also contain other information 122 in the form of a book, CD, DVD or other means of storing information for encouraging, educating, entertaining and motivating children.

Figure 5:
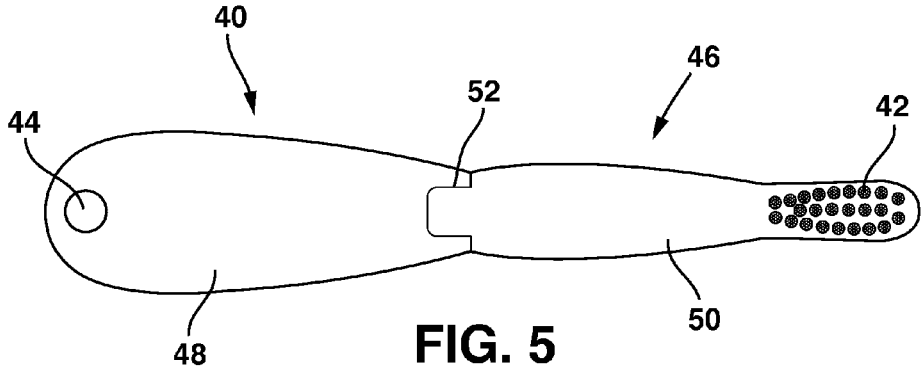
FIG. 5 is a top view of a toothbrush of the dispenser embodiment of FIG. 1.
Figure 6:
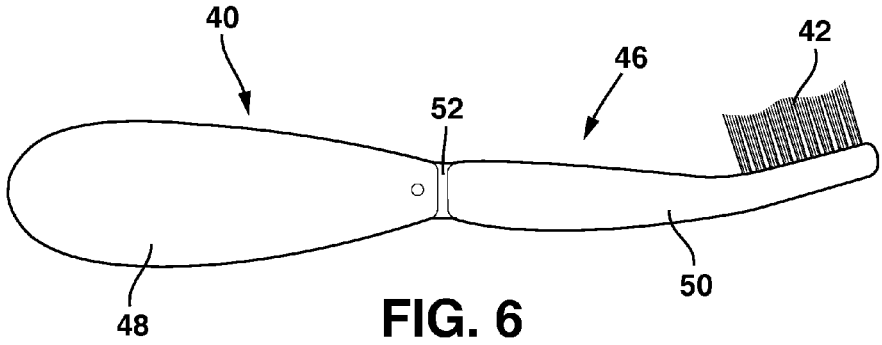
FIG. 6 is a side view of a toothbrush of the dispenser embodiment of FIG. 1 in a straight configuration.
Figure 7:
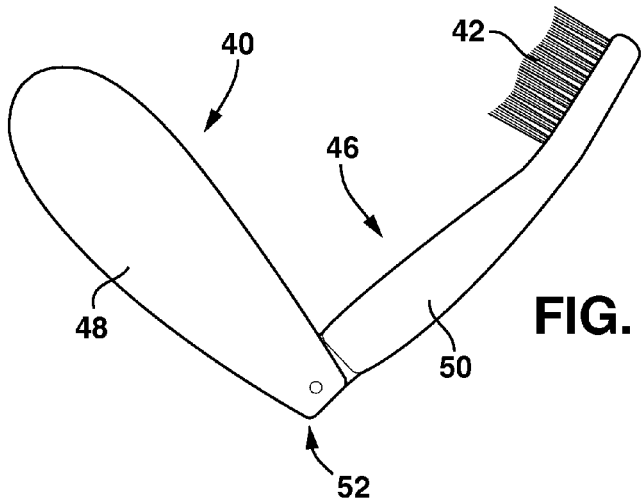
FIG. 7 is a side view of the toothbrush of FIG. 5 in a bent configuration.
Figure 8:
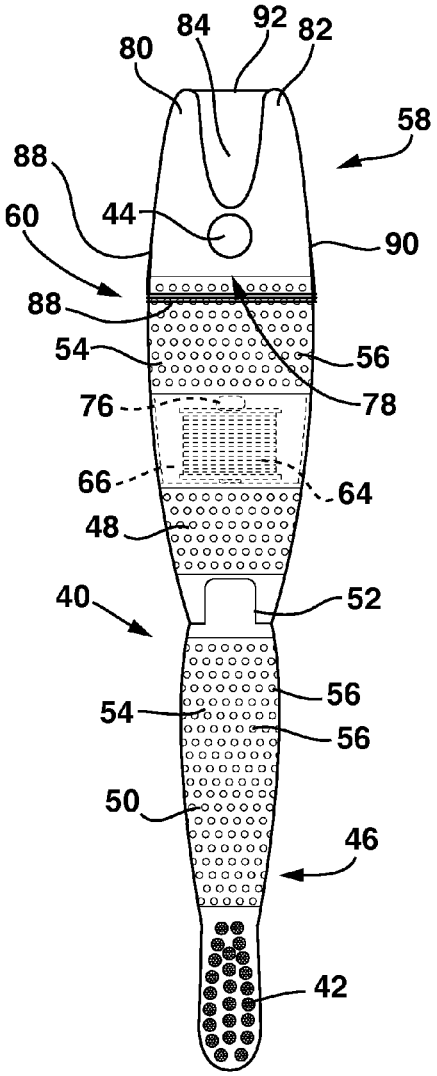
FIG. 8 is a top view of an alternate embodiment of a toothbrush of the dispenser embodiment of FIG. 1.
Figure 9:
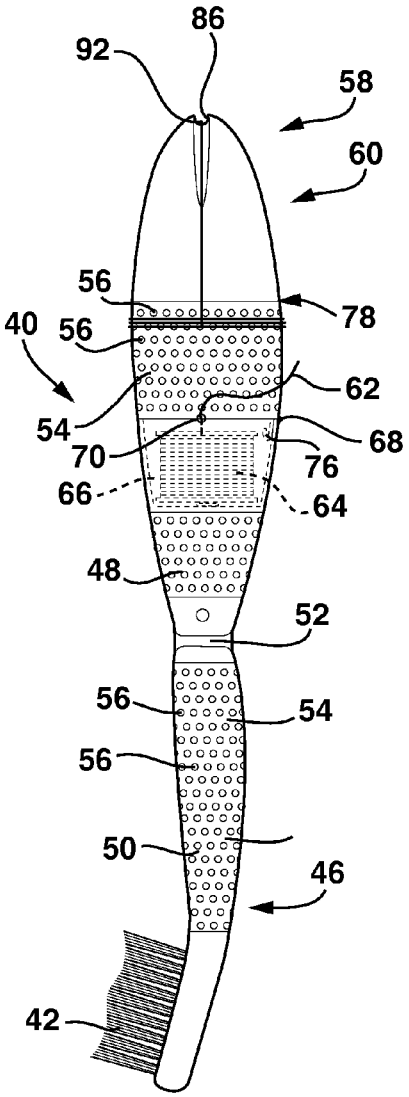
FIG. 9 is a side view of the alternate embodiment of a toothbrush of FIG. 8.
Figure 10:
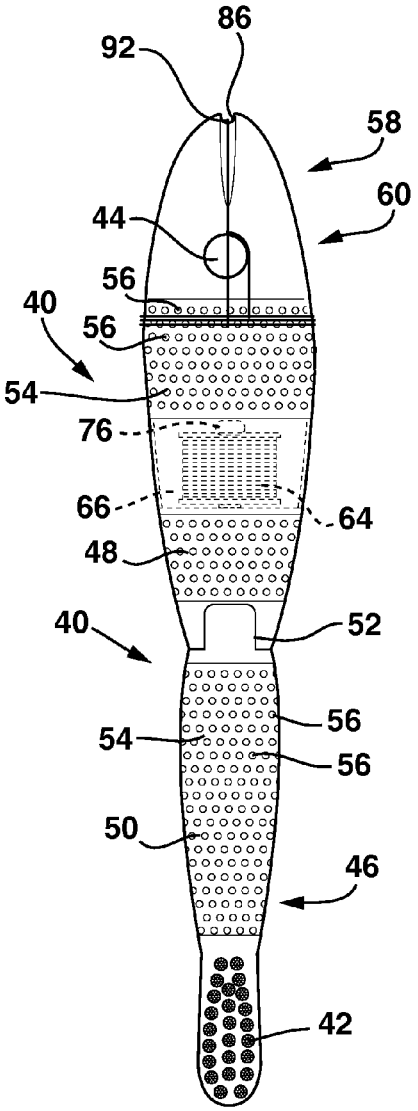
FIG. 10 is a top view of an alternate embodiment of a toothbrush of the dispenser embodiment of FIG. 1.
Figure 11:
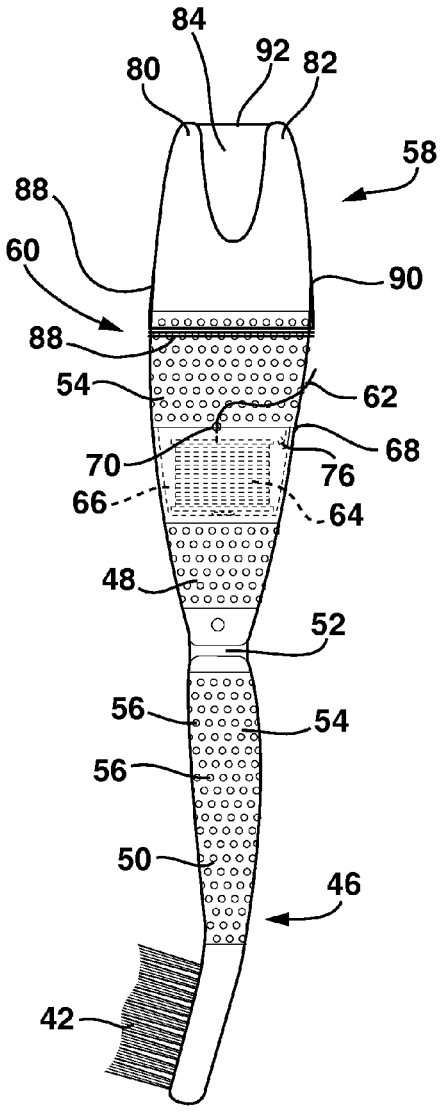
FIG. 11 is a side view of the alternate embodiment of a toothbrush of FIG. 10.

In a most preferred embodiment of the invention, the toothbrushes 40 are shaped to approximate the shape of legs of a character 8. Consequently, in this embodiment the toothbrush 40 has "legs" 32 made of an upper leg 48, a lower leg 50 and a knee 52 (FIGS. 5-7). The legs 46, in their configuration where the toothbrush 40 is being used to brush teeth, are preferably slightly bent at the knee 52 so that the toothbrush 40 facilitates proper brushing.

In a preferred embodiment, the legs 46 have a knee 52 that is bendable. In other words, the knee 52 allows the upper leg 48 and the lower leg 50 to be bent around the knee 52 so that the upper leg 48 and the lower leg 50 may assume a configuration like that of a real bent leg. The knee 52 preferably has means for locking the knee, more preferably in the form of a protrusion and detent system or a threaded post and nut as are well understood in the art, that locks the knee in a straight configuration or a bent configuration as desired. In addition to making the legs 46 look like "real" legs, the knees 52, when in the bent configuration, allow the toothbrush 40 to assume a configuration that may allow for easier handling and brushing behind teeth. If the child uses the toothbrush 40 in a bent configuration to brush his or her teeth, after use the legs 46 of the toothbrush may be straightened and then "clicked" into the original straight shape by "locking" the detent in this shape.

The legs 46 also preferably have a length that allows them, when attached to the hooks 38, to rest on the indentation 14 formed in the base 12. The indentation 14 may have shapes or designs incorporated into or on the indentation 14 that may be associated with the character 8 of the dispenser 10 or associated with encouraging and motivating a child to brush his or her teeth.

The legs 46 preferably have a coating 54 on at least a portion of the leg 46 that increases the friction along that portion of the leg 46 containing the coating 54. The coating 54 is preferably a natural or artificial rubber surface that is either attached to or formed with the leg 46 and may contain ridges or bumps 56 to further increase the friction producing ability of the coating beyond that inherent in the material of the coating 54 alone. The coating 54 preferably extends entirely around the leg 46 where the coating 54 is located. Although the leg 46 preferably contains a coating 54 as described above, a coating 54 is not required. Further, the coating 54 may be made of any material that produces friction and is compatible with being used by children in a bathroom environment. In addition, may also extends around only a portion of the leg 46 where the coating 54 is located.

In another embodiment of the dispenser 10, at least one of the legs 46 has a floss holder 58. In a preferred embodiment of the dispenser 10, the floss holder 58 is located at an end 60 opposite the bristles 42. In another embodiment of the dispenser 10, the floss holder 58 is located at an end near the bristles 42. The floss holder 58 holds floss 62, both to store the floss 62, but also in preferred embodiments so that the end 60 of the legs 46 can also be used to floss the user's teeth. The floss 62 may be conventional floss or may also be floss that is colored or flavored to match a color or flavor associated with a color or flavor of a character 8.

In the embodiment of the legs 46 shown in FIGS. 8-11, the floss 62 is located on a spool 64 that is located in a compartment 66 in the leg 46. The spool 64 may either be permanently affixed within or formed as part of the compartment 66 so that the floss 62 is wound around the spool 64 in the compartment 66. Alternately, the spool 64 is replaceably located in the compartment 66 so that the floss 62 is wound on the spool 64 away from the leg 46 and then brought to and located in the compartment 66. In the latter embodiment, the spool 64 may be affixed within the compartment 66 by frictional connection, mechanical connection or other means that will be clear to those skilled in the art, the key being that the spool 64 is securely located in the compartment 66 when desired and removable from the compartment 66 when desired.

In the embodiment of the dispenser 10 shown in FIGS. 8-11, access is had to the compartment 66 by pivoting the end 60 around a living hinge 68 so that the compartment 66 is exposed. In this embodiment, the compartment 66 is closed by pivoting the end 60 around the living hinge 68 back into contact with the main part of the leg 46 where the end 60 may be retained in contact with the leg 46 by techniques well understood in the art including but not limited to frictional contact, mechanical connection or adhesives. In this embodiment, the floss 62 may exit the compartment 66 through an exit hole 70 passing from outside the leg 46 into the compartment 66. Although a living hinge 68 is used in this embodiment to allow access to the compartment 66, the compartment 66 may be accessed by other means including, but not limited to, having an opening from the compartment 66 to the outside or having a door that opens around a hinge or is removable to allow access to the compartment 66.

In either embodiment of the spool 64, the leg 46 also preferably includes a cutter 76 for cutting the floss 62. The cutter 76 is preferably a simple sharpened edge, preferably metal attached to or embedded in the compartment 66, such as is commonly used for cutting floss in traditional floss dispensing systems.

The floss holder 58 shown in FIGS. 8-11 is located at an end 60 opposite the bristles 42. In this embodiment of the floss holder 58, the floss holder 58 is able to rotate around the end 60. Although the end 60 may rotate around the end 60, it is preferable that the end 60 not rotate freely but instead rotate only when a certain amount of pressure is applied. This may be accomplished by placing the floss holder 58 on a rotating bearing 78. The bearing 78 itself may either be of the type that rotates but only if a certain amount of force is applied. Or, the bearing 78 may rotate freely but the leg 46 may have a frictional contact between the floss holder 58 and the leg 46 at the end 60 so that friction between the floss holder 58 and the rest of the leg 46 holds the floss holder 58 in a desired configuration in normal use. In either way, the floss holder 58 may be rotated into a desired configuration for flossing teeth and be retained in this position in order to make flossing easier.

In an alternate embodiment of the dispenser 10, the floss holder 58 of any of the embodiments described herein is removably attached to the toothbrush 40. This removable attachment may be accomplished by frictionally or mechanically coupling the floss holder 58 to the toothbrush 40 (e.g., through a frictional male/female coupling or mechanical finger/detent coupling) so that the floss holder 58 is retained in contact with the toothbrush 40 while the user is using the floss holder 58. However, after using the floss holder 58, the entire floss holder 58 is removed by overcoming the frictional or mechanical coupling so that the floss holder 58 can be discarded or have new floss 62 placed on it. In this embodiment, multiple floss holders 58 could be provided with the floss 62 already attached so that a new floss holder 58 with new floss 62 could be applied to a toothbrush 40 when the user desires to floss and then the floss holder 58 is removed from the toothbrush 40 after flossing and discarded.

The floss holder 58 includes a first ridge 80 and a second ridge 82 located at the ultimate end of end 60 and has a slot 84 formed between the first ridge 80 and second ridge 82. The floss holder 58 also includes a groove 86 located at approximately a right angle to the first ridge 80, second ridge 82 and slot 84. The groove 86 has a width and a depth slightly wider and deeper than the diameter of the floss 62 that will be used in the floss holder 58.

In use, a desired length of floss 62 is removed from the spool 64 and cut by the cutter 76 producing a piece of floss 62 having a first end 88 and a second end 90. The user then aligns a middle portion 92 of the floss 62 in the groove 86 and wraps the first end 88 of the floss 62 several times around a portion of coating 54 located near the end 60 of the leg 46 leaving enough of the first end 88 not wrapped around the leg 46 to makes several such wraps for a purpose that will be explained hereafter. Frictional contact between overlapping strands of the first end 88 of the floss 62 and the coating 54 holds the first end 88 of the floss 62 in secure contact with the coating 54. The free portion of the floss 62, that is, the portion of the floss 62 extending from the portion of the first end 88 that is wrapped around the coating 54, is stretched across the groove 86 between the first ridge 80 and second ridge 82 so that the middle portion 92 of floss 62 spans the slot 84. The floss 62 is pulled tight so that the floss 62 is taught across the slot 84. The portion of the first end 88 of the floss 62 that was previously not wrapped around the leg 46 in contact with the coating 54 is then wrapped over the second end 90 and wrapped several times around the leg 46 in taut contact with the coating 54. As a result, the second end 90 of the floss 62 is held in secure and tight contact with the leg 46 at the coating 54. This allows the middle portion 92 of the floss 62 to remain taut in the groove 86 spanning the slot 84 between the first ridge 80 and second ridge 82.

As stated above, the dispenser 10 includes a base 12. In a preferred embodiment of the dispenser 10, a suction cup 98 is placed under the base 12 allowing the base 12 to be firmly attached to a bathroom counter or other flat surface. Alternately, a clamp, adhesive or any other commonly used attachment mechanisms or methods may be used to attach the base 12 to a bathroom counter or other flat surface.

Also in a preferred embodiment, the dispenser 10 includes a communication system 100 for communicating with the child user. For example, the dispenser 10 in one embodiment includes a communication system 100 having one or more buttons 102 or similar controlled device that, when pressed, cause the communication system 100 to do such things as emit laughter, voices, sounds made by a mouth, singing or aural or visual instruction about brushing teeth or starting or stopping timers (e.g., for the length of time spent brushing) or activating or incrementing counters (e.g., the number of times a child has brushed his or her teeth). As a result, the communication system 100 includes some way of communicating with the user such as through one or more speakers 104 or a graphical display 106 such as an LCD, LED or similar display. Such communication systems 92, including speakers 104 and graphical displays 102, are well understood in the art and may include or be controlled by a microprocessor or application specific integrated chip (ASIC) usually with a memory or other media (e.g., tape or disk) for storing and making available files, sounds and commands that, when called by pressing the buttons 102, communicate with the child user.

The communication system 100 may include effectors, such as end-effectors, that move in response to control signals from the microprocessor or ASIC. For example, an effector may interact with toothpaste tube 20, which is preferably in the shape of the face or face and body of a character 8, causing an aspect of the face or body of the character 8, including a mouth or eyelids, to move or appear to move in response to commands from the microprocessor or ASIC that are preferably correlated with an aural or visual message or both from the dispenser 10 through the communication system 100. In addition, the effectors, such as piezo-electric effectors and piezo-electric end-effectors, can be located directly on or connected to the toothpaste tube 20 so that activating the effector causes parts of the toothpaste tube 20 to move. Where such effectors are associated with features on the toothpaste tube 20 corresponding to, for example, a mouth or eyelids, activating the effectors causes the features to appear to move. Such communication systems 92 may be powered by a battery or by plugging the dispenser 10 into wall current.

The function of the dispenser 10 is to replicate a character 8, facilitate easy brushing and invite children to brush so that brushing may be done without assistance or with minimal assistance from adults. The addition of sound or other communication from the communication system 100 aids in the delivery of the desirable message and in the making the dispenser 10 more attractive to the child user.

The invention in another embodiment includes a method for motivating children to brush their teeth. In this embodiment, colored toothpaste is provided to the child through a toothpaste tube 20. The child is instructed, either by a message communicated from the communication system 100, through advertising or other media including, but not limited to, books, comic books, TV shows, instructional videos, games, jingles, websites or songs to "brush until the color's gone."

An example of a song that a child might be taught through a character 8 or that a character 8 might sing, in any of the embodiments of the invention described herein, to help them internalize the message of "brush until the color's gone" is:

When I go to brush.
I know what to do.
I brush until the color's gone.
And I smile a Toothy Smile.
Toothy Smile.
Toothy Smile.

I'm a Toothy Fruity Smile.

Obviously, other songs may be constructed to communicate the desired message of "brush until the color's gone" or other messages promoting practices to enhance healthy teeth.

The basis for the statement "brush until the color's gone" is that colored toothpaste will gradually change from its original color to white as it is correctly being used to brush the teeth. As a result, after a sufficiently long time of brushing the teeth, the color of the toothpaste on the child user's teeth will change from its original color to white. This change will be apparent to the child user and the desire to achieve this color change will motivate the child user to continue brushing his or her teeth until the desired visible change has occurred. The natural tendency of the child user to effectuate this color change will be bolstered by the communication of the message "brush until the color's gone" from the invention in all its embodiments including through the communication system 100.

In addition to using colored toothpaste, it is also preferable to have flavored toothpaste in order to make the toothpaste more attractive to the child user. In a preferred embodiment, the flavor of the toothpaste corresponds to the food producing the flavor. For example, orange colored toothpaste may have the flavor of an orange and yellow colored toothpaste may have the flavor of a banana. Of course, other exotic colors and flavor combinations may be used. The combination of interesting and attractive colors with desirable and pleasing toothpaste flavors will also be an incentive to the child user to use the toothpaste and brush his or her teeth.

Figure 12:
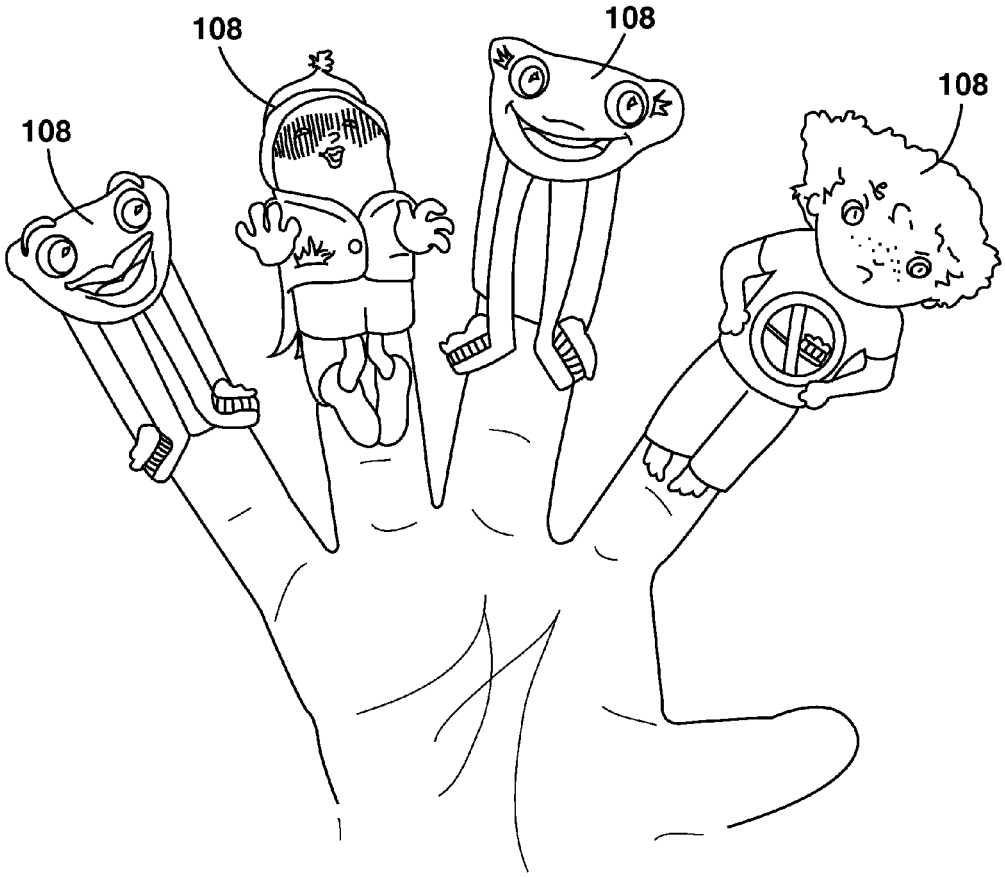
FIG. 12 is a perspective view of finger puppet embodiments of the invention.
Figure 13:
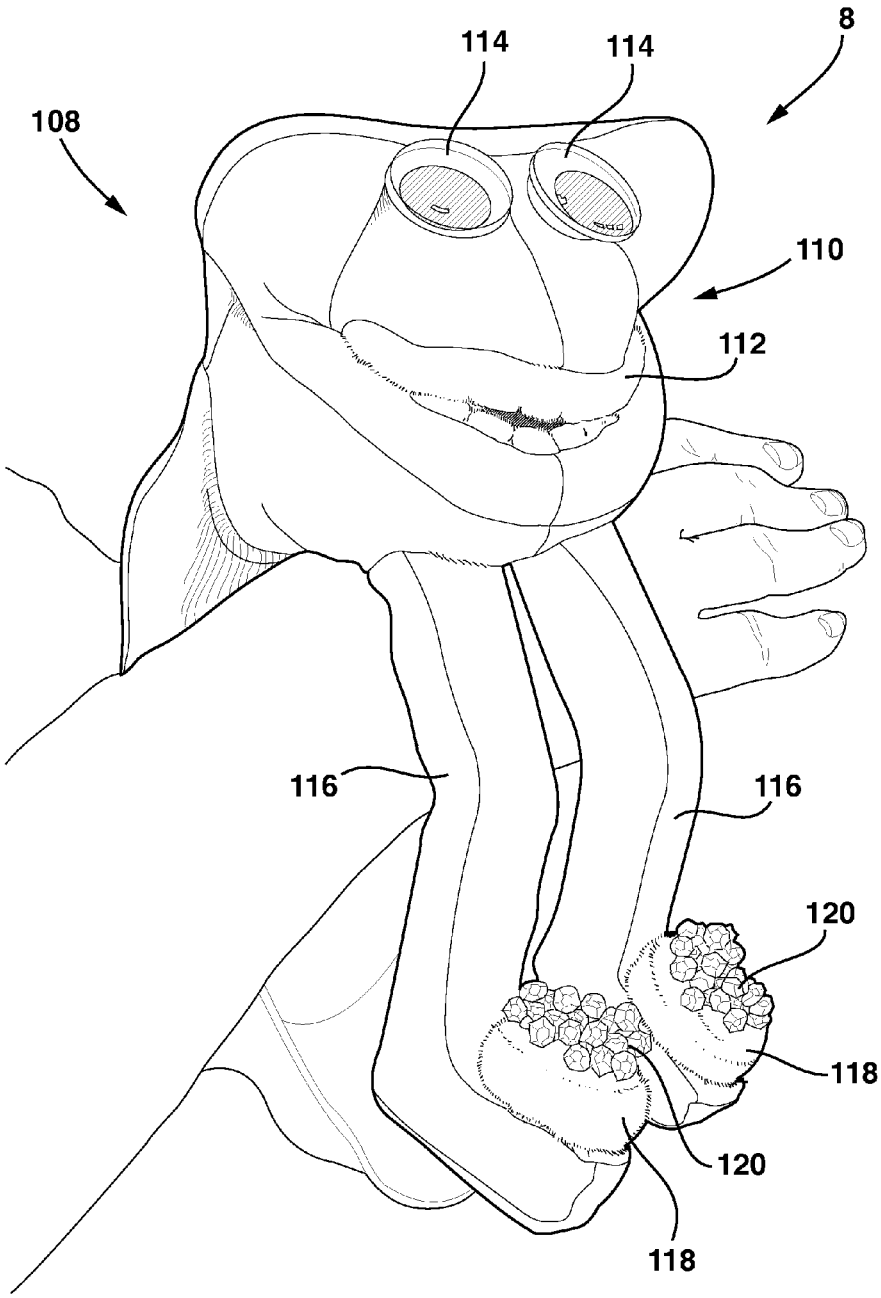
FIG. 13 is a perspective view of a hand puppet embodiment of the invention.

The invention, in another embodiment shown in FIG. 12-13, includes at least one character 8 in the form of a finger or hand puppet 108. One embodiment of the hand puppet 108 has a body 110 shaped like a smile preferably having a smiling face 112 and smiling eyes 114. By "smiling face" I mean that the face is dominated by and is in part in the shape of a smile. By "smiling eyes" I mean that the eyes are large and bright.

In addition, the puppet 108 preferably has toothbrush-like legs 116 with bristle-like members 118 at one end and what appears to be "toothpaste" 120 on the bristle-like members 118. The puppet 108 may have a wide variety of possible "looks" by incorporating lips, mouth shapes, eyelashes, eyebrows, mustaches, freckles, cheeks, eyewear, masks and other "disguises" that generate a seemingly never-ending assortment of characters 8. As stated above, all puppets 54 preferably have names identifying the color of corresponding toothpastes, and as stated above, incorporate a mouth sound, behavior, feeling or identifying feature of a face (e.g., Berry Burp, Puckerlips Lemon, Mustache Maraschino, Kiss Me Kiwi, Oh, oh Orange, Blowing Raspberries and Cherry Cheery).

The hand puppet 108 can be used by the child user as a toy or can be used as part of an entertainment program, commercial or marketing as a spokes-character for the act of brushing or for the toothpaste 22 or toothbrush 40 itself. For example, the puppet 108 could appear on a television show, in an educational video or in a book, magazine or coloring book in an engaging and entertaining way such singing to, talking with, joking with and having fun with the children to educate, motivate and encourage the children to brush their teeth. In this way, the child user will develop an affinity for the character 8 and the message of good brushing habits espoused by the character 8.

Figure 14:
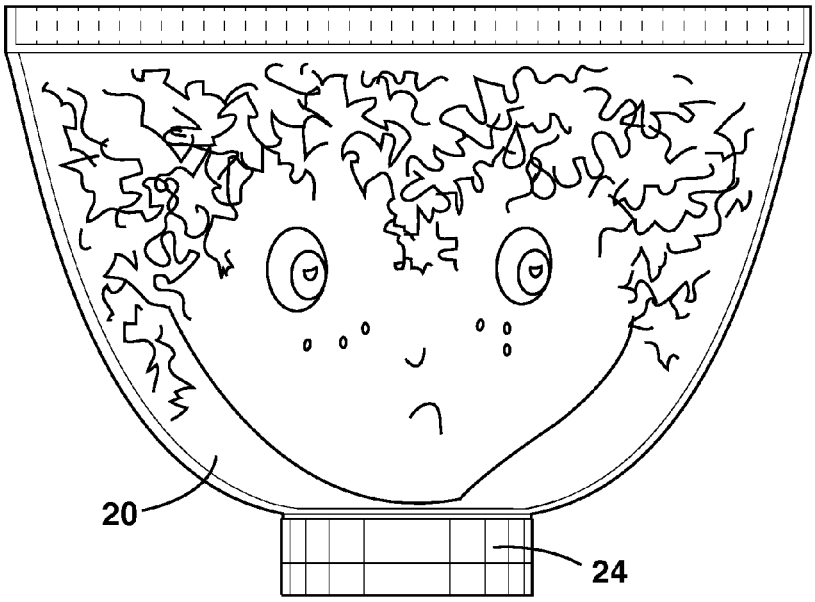
FIG. 14 is a front view of a toothpaste tube embodiment of the invention.
Figure 15:
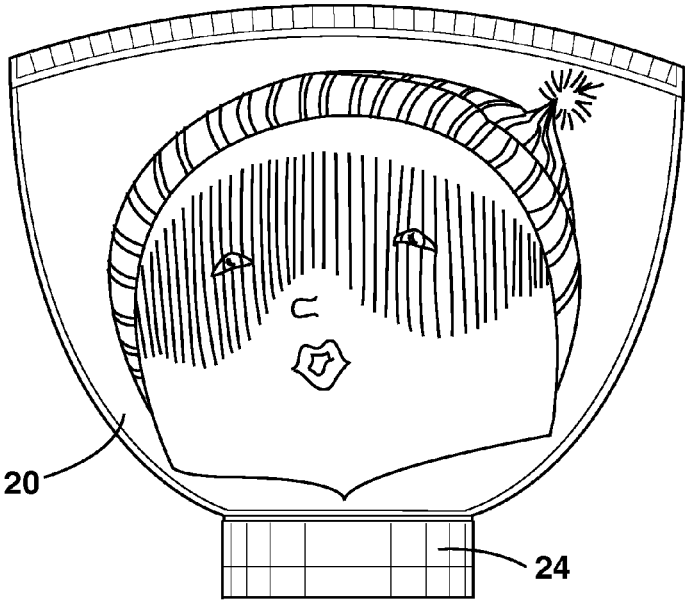
FIG. 15 is a front view of a alternate toothpaste tube embodiment of the invention.

The invention, in another embodiment shown in FIG. 14-15, includes at least one toothpaste tube 20 with or without a flip-top cap 24 and having an identifying feature of a face (e.g., Susie and Toothie Bandie).

The invention in an embodiment includes a method for entertaining, educating and motivating children to brush their teeth. This method comprising the steps of:

Creating a character 8 having features desirable or attractive to children;

Providing a toothpaste dispenser 10, toy or puppet 108 in the form of the character 8 wherein the dispenser 10, toy or puppet 108 is capable of presenting visual or aural messages;

Causing the dispenser 10, toy or puppet 108 to present a visual or aural message encouraging, instructing or otherwise motivating a user of the dispenser 10, toy or puppet 108 to brush their teeth.

The invention in another embodiment includes a method for entertaining, educating and motivating children to brush their teeth. This method comprising the steps of:

Creating a character 8 having features desirable or attractive to children;

Providing a media displaying the character 8 wherein the media presents visual or aural messages;

Causing the media to present a visual or aural message encouraging, instructing or otherwise motivating a user, viewer or listener of the media to brush their teeth.

The description contained herein is intended to be illustrative and not exhaustive. Many variations and alternatives of the described technique and method will occur to one of ordinary skill in this art. Variations in form to the component pieces described and shown in the drawings may be made as will occur to those skilled in the art. Further, although certain embodiments of a dispenser 10 or puppet 108 have been described, it is also within the scope of the invention to add other additional components such as other hygiene products, clothes, wardrobe accessories, sports equipment or paraphernalia, logos or trademarks to name but a few possibilities or to make the character 8 in the form of a toy or pillow. All these alternatives and variations are intended to be included within the scope of the attached claims. Those familiar with the art may recognize other equivalents to the specific embodiments described herein which equivalents are also intended to be encompassed by the claims attached hereto.

As a result, while the above description contains many specific elements, dimensions, functions and parameters, these should not be construed as limitations on the scope of the invention but rather as examples of different embodiments thereof. Many other variations are possible. Accordingly, the scope of the invention should be determined not by the embodiments illustrated but by the appended claims and their legal equivalents.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A toothpaste dispenser having an appearance of a character, the toothpaste dispenser comprising:

a base;

a support extending from a first end essentially vertically from the base; and a toothpaste tube holder located at a second end of the support opposite the first end, the toothpaste tube holder capable of being removably coupled to a toothpaste tube, wherein the base comprises a plurality of indentations therein each to receive a first end of a toothbrush and the toothpaste holder comprises a plurality of hooks each correspondingly located thereon to receive a second end of the toothbrush, the toothpaste tube comprises at least one of facial and body features, the dispenser comprising a plurality of toothbrushes, each having a shape of the character's leg, the indentations and hooks located on the dispenser for the toothbrushes to appear as legs extending from the toothpaste tube.

2. The toothpaste dispenser of claim 1, wherein the base comprises at least indentation therein to receive a first end of a toothbrush and the toothpaste holder comprises at least one hook correspondingly located thereon to receive a second end of the toothbrush.

3. The toothpaste dispenser of claim 1, wherein the toothpaste tube comprises at least one of facial and body features.

4. The toothpaste dispenser of claim 1, wherein the toothpaste tube holder is cylindrically concave and sized to receive a toothpaste tube with a flip-top cap and frictionally retain the toothpaste tube therein.

5. The toothpaste dispenser of claim 1, wherein the toothpaste tube holder has a plurality of air holes located annularly therein.

6. The toothpaste dispenser of claim 1, wherein the toothpaste tube holder is cylindrically concave and wherein an internal surface of the cylindrical tube holder has threads sized to mate with threads on a dispensing end of the toothpaste tube.

7. The toothpaste dispenser of claim 1, wherein the toothpaste tube comprises a dispenser having a conduit there through to dispense toothpaste from the toothpaste tube.

8. The toothpaste dispenser of claim 1, wherein each of the toothbrushes comprises a bendable knee with a plurality of detents that locks in a shape in one of a plurality of configurations.

9. The toothpaste dispenser of claim 1, wherein each of the toothbrushes comprise a friction surface.

10. The toothpaste dispenser of claim 1, wherein at least one of the toothbrushes comprises a floss holder located at an end of the toothbrush opposite the bristles thereof.

11. The toothpaste dispenser of claim 10, wherein the floss holder includes a first ridge and a second ridge located at an end of the toothbrush and has a slot formed between the first ridge and the second ridge, the floss holder further includes a groove located at approximately a right angle to the first ridge, second ridge and a slot between the ridges, the groove has a width and a depth slightly wider and deeper than a diameter of floss used in the floss holder, the floss usable by pulling the floss taught across the slot.

12. The toothpaste dispenser of claim 1, wherein the base comprises a communication system operable to track and communicate to a user at least one of time spent brushing and a number of times teeth were brushed.

13. The toothpaste dispenser of claim 1, wherein the toothpaste dispenser comprises animated at least one of facial and body features.

14. The toothpaste dispenser of claim 13, wherein the animated feature comprises one of a mouth and eyelids.

15. The toothpaste dispenser of claim 14, wherein the dispenser comprises at least one sensor that detects usage and causes the animated features to move in response to usage.

16. The toothpaste dispenser of claim 1, wherein the dispenser dispenses toothpaste that changes from a first color to another color as the user brushes with the toothpaste.

17. A toothpaste dispenser having an appearance of a character, the toothpaste dispenser comprising:

a base;

a plurality of toothbrushes;

a support extending from a first end essentially vertically from the base; and a toothpaste tube holder located at a second end of the support opposite the first end, the toothpaste tube holder capable of being removably coupled to a toothpaste tube, wherein the toothpaste tube comprises at least one of facial and body features, the base comprises at least one indentation therein to receive a first end of a toothbrush and the toothpaste holder comprises at least one hook correspondingly located thereon to receive a second end of the toothbrush, the toothbrushes having a shape of the character's leg, the at least one indentation and the at least one hook located on the dispenser for the toothbrushes to appear as legs extending from the toothpaste tube.

18. The toothpaste dispenser of claim 17, wherein each of the toothbrushes comprises a bendable knee with a plurality of detents that locks in a shape in one of a plurality of configurations.

19. A toothpaste dispenser having an appearance of a character, the toothpaste dispenser comprising:

a base;

a support extending from a first end essentially vertically from the base; and a toothpaste tube holder located at a second end of the support opposite the first end, the toothpaste tube holder capable of being removably coupled to a toothpaste tube, wherein the toothpaste dispenser comprises animated at least one of facial and body features, including a mouth and eyelids, and wherein the dispenser comprises at least one sensor that detects usage and causes the animated features to move in response to usage.

* * * * *